US009161670B1

(12) United States Patent
Morad et al.

(10) Patent No.: US 9,161,670 B1
(45) Date of Patent: Oct. 20, 2015

(54) SPONGE ROLLER MOP WITH QUICK RELEASE MECHANISM TO REMOVE A DIRTY SPONGE FROM THE HOUSING WITHOUT HAVING TO TOUCH THE DIRTY OR CONTAMINATED SPONGE

(71) Applicants: Fred I. Morad, Toluca Lake, CA (US); George Mardres, Jr., La Crescenta, CA (US)

(72) Inventors: Fred I. Morad, Toluca Lake, CA (US); George Mardres, Jr., La Crescenta, CA (US)

(73) Assignee: Worldwide Integrated Resources, Inc., Montebello, CA (US)

( * ) Notice: Subject to any disclaimer, the term of this patent is extended or adjusted under 35 U.S.C. 154(b) by 0 days.

(21) Appl. No.: 14/595,134

(22) Filed: Jan. 12, 2015

Related U.S. Application Data

(60) Provisional application No. 62/017,772, filed on Jun. 26, 2014.

(51) Int. Cl.
*A47L 13/144* (2006.01)
*A47L 13/24* (2006.01)

(52) U.S. Cl.
CPC ..... *A47L 13/144* (2013.01); *A47L 13/24* (2013.01)

(58) Field of Classification Search
CPC ..... A47L 13/144
See application file for complete search history.

(56) References Cited

U.S. PATENT DOCUMENTS 7,178,189 B1 * 2/2007 Perry et al. ..... 15/119.2

* cited by examiner

*Primary Examiner* — Shay Karls
(74) *Attorney, Agent, or Firm* — Thomas I. Rozsa

(57) ABSTRACT

A mechanism by which the mop of a sponge roller mop is released without a user having to touch a dirty mop so that the sponge can be released and replaced with a clean sponge, including a sponge pin molded onto the brace which retains the sponge. The mechanism includes a transverse section with a movable hole through which the crown from the sponge pin is inserted. The wall is moved by a transverse spring force so that the wall from the opening of the trigger mechanism is placed between the crown and a lower section of the sponge pin to thereby retain the crown within the rod retaining mechanism. When a pushbutton is pushed transversely, it overcomes the spring force so that the crown is released and a downward force from the vertical compression spring forces the crown downwardly and out of the trigger mechanism, thereby releasing the sponge.

9 Claims, 15 Drawing Sheets

SPONGE ROLLER MOP WITH QUICK RELEASE MECHANISM TO REMOVE A DIRTY SPONGE FROM THE HOUSING WITHOUT HAVING TO TOUCH THE DIRTY OR CONTAMINATED SPONGE

CROSS-REFERENCE TO RELATED APPLICATION

1. This patent application claims priority to Provisional Application No. 62/017,772 filed on Jun. 26, 2014.

BACKGROUND OF THE INVENTION

1. Field of the Invention

The present invention relates to sponge roller mops where the sponge is retained in a plastic brace or metal brace and a pair of roller mechanisms are on opposite sides of the plastic brace or metal brace so that when the sponge is in the operative condition, the roller mechanisms are in a raised condition and the sponge can be used to mop a floor and when the sponge is pulled through the roller mechanisms, the sponge is wrung dry so that the sponge can be dipped in soapy water to continue the cleaning process which is primarily for floors and horizontal surfaces.

2. Description of the Prior Art

In the prior art, the mechanism is as described in the Field of the Invention section having a sponge which is retained within a plastic or metal brace and having two roller mechanisms which in the use condition, are in an unelevated condition so that the sponge can be used to mop a floor or other vertical surface and with the rollers in the elevated condition, the sponge can be pulled through the two rollers so that water is wrung out of the sponge and when the sponge is returned to its original condition, the sponge can then be dipped in additional soapy water to continue the mopping operation until the sponge is so dirty that it can be no longer used. When the sponge is in the condition where it can be released, in the prior art that is known to the present inventors, the brace retaining the sponge needs to be slid out of the roller mechanism or through use of a J-hook retaining mechanism to remove the brace and mop from the rollers and the person has to have the person's hand touch the dirty mop. When the sponge gets used or too dirty, the operator needs to replace the sponge with a new sponge. The operator needs to hold the sponge and use his/her hand to grip the sponge and thereafter either slide the brace on opposing tracks inside opposing rollers or physically move the brace and sponge through a lifting mechanism such as lifting over J-hook. As a result, it is necessary to hold the dirty sponge in order to remove it from the roller mechanism.

There is a significant need for an improved invention which will enable a user to have the used or dirty sponge released so that the user does not have to touch the dirty and used sponge and can replace the sponge with a new clean sponge.

SUMMARY OF THE INVENTION

The present invention is a mechanism by which the mop of a sponge roller mop is released without a user having to touch a dirty sponge so that the sponge can be released and replaced with a clean sponge. The improvement of the present invention includes having a sponge pin molded into the brace which retains the sponge. The sponge pin has several sections including a wide section which is molded onto the brace, an intermediate section, a narrow section and a crown.

The mechanism includes a transverse section having a movable pushbutton which includes a transverse hole through which the crown of the sponge pin is inserted and then a wall of the transverse hole retains the sponge pin in a gap between the upper crown section and the intermediate crown section. The pushbutton is moved in a transverse direction through a transverse spring which creates a transverse force so that the wall of the opening of the pin is placed between the crown and a lower section of the sponge pin to thereby retain the crown within a rod retaining mechanism.

In addition, the crown pushes against an internal vertical piston which then pushes against a vertical compression spring retained within a housing of the rod retaining mechanism. When this action occurs, the vertical compression spring is pushed into a compressed condition. Concurrently, there is a transverse pushbutton which contains through its thickness an opening having a sidewall which is aligned with the internal vertical piston, the pushbutton forced into this condition by force of a transverse coil spring retained between a proximal face of the pushbutton and an interior wall of an exterior transverse wall. As a result, when the crown of the sponge pin is pushed through the hole, the sidewall of the hole through the force of the transverse spring causes a portion of the sponge pin between a lower surface of the crown and an upper surface of an interior cylindrical section which is a gap to retain the sponge pin within the sidewall of the pushbutton hole. Therefore, the trigger mechanism of the present invention is in the locked condition. In order to create an unlocked condition, the lever handle is caused to move into a further downward position adjacent the handle of the sponge mop (as will be discussed) so that the metal brace or plastic brace is pushed away from and below the pair of rollers and thereafter the pushpin is pushed at a distal end in a transverse direction to overcome the force of the transverse coil spring so that the crown of the sponge pin is aligned with the hole in the pushbutton and thereafter the force of the vertical compressed coil spring forces the pushbutton out of the opening and out of the trigger mechanism so that the sponge and sponge pin molded thereto are released from the trigger mechanism and are replaced with a new sponge brace and sponge pin.

The assembly is concealed with a housing which has a vertical opening to expose the pushbutton. First, a lever handle is pushed to a third or releasing condition to cause a sponge retaining brace to be disengaged from a pair of rollers. Then a user is able to release the sponge brace and sponge pin by exerting a transverse pushing force on the distal end of the pushpin which overcomes the biasing force of the transverse spring and aligns the crown of the sponge pin with the opening and with the piston so that the downward force of the vertical spring causes the sponge pin to be pushed out of the hole in the pushbutton and be ejected from the trigger mechanism so that the entire assembly of the sponge pin, sponge retaining brace and sponge and sponge pin are released and can be replaced with a new assembly of a new sponge pin, sponge brace and sponge. It is important to note that before the transverse force is exerted on the pushbutton, the lever handle needs to be moved to a third position (as will be described) so that it is adjacent the handle which causes the brace to be in a position lower than the rollers to facilitate the transverse force on the pushbutton rollers to be released.

It is an object of the present invention to have an assembly where a roller mop can be released from the rollers by having a spring actuated mechanism to cause a sponge pin which is affixed to the bracket or brace which retains the sponge to be pushed out of a rod retaining mechanism so that the sponge is freed from the roller mop assembly without having to touch the sponge and a new clean sponge with a brace and molded sponge pin can be inserted into the rod retaining assembly.

It is a further object of the present invention to eliminate the need for having tracks on rollers which retain the brace of a sponge roller mechanism requiring a user to slide the brace in one direction or the other on the tracks or have some other retaining mechanism such as a J-hook through which the brace needs to be lifted, so that a user must touch a dirty sponge to remove it. The present invention eliminates this requirement by eliminating the tracks and instead having the pushbutton mechanism which releases a lock on the crown affixed to the brace of a sponge and exerts a downward force from a vertical compression spring on a vertical piston which then impacts a top of the crown to push the sponge assembly which includes the sponge pin, brace and mop away from the roller mop without having to touch the sponge.

It is another object of the present invention to create a sponge roller mop assembly where the sponge pin retaining assembly is concealed by a housing so that it is kept clean and will not have debris interfere with its mechanism but at the same time, the housing has an opening to permit a user to have access to the pushbutton to free the sponge pin from its locked position within the rod retaining assembly.

It is a further object of the present invention to improve a sponge roller mop by having a quick release mechanism to remove a dirty sponge from the housing without having to touch the dirty sponge or contaminated sponge.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF EMBODIMENTS OF THE PRESENT INVENTION

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
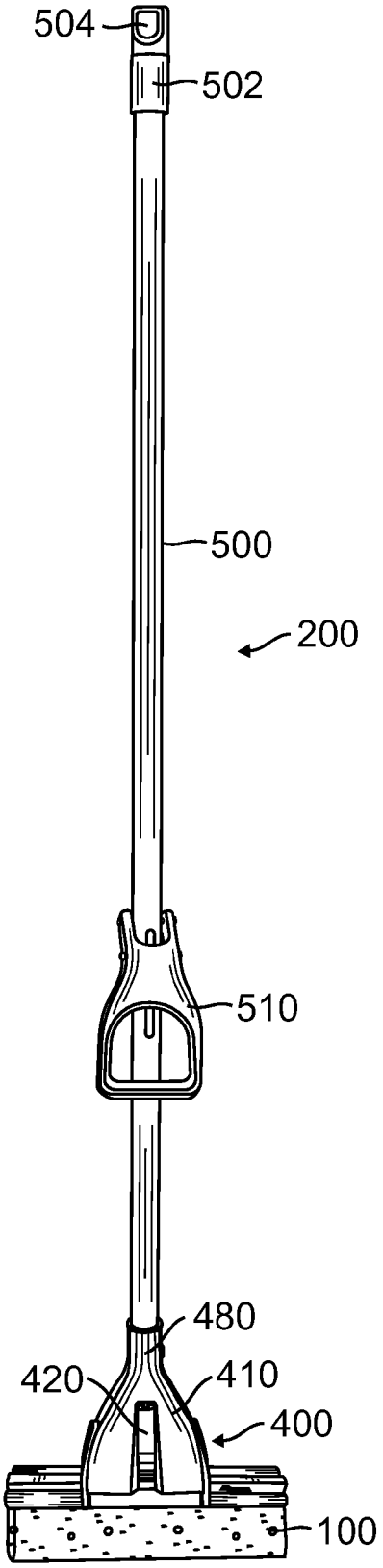
FIG. 1 is a front elevational view of the completed sponge roller mop with the quick release mechanism in place and the lever wringer in an unactivated position.
Figure 2:
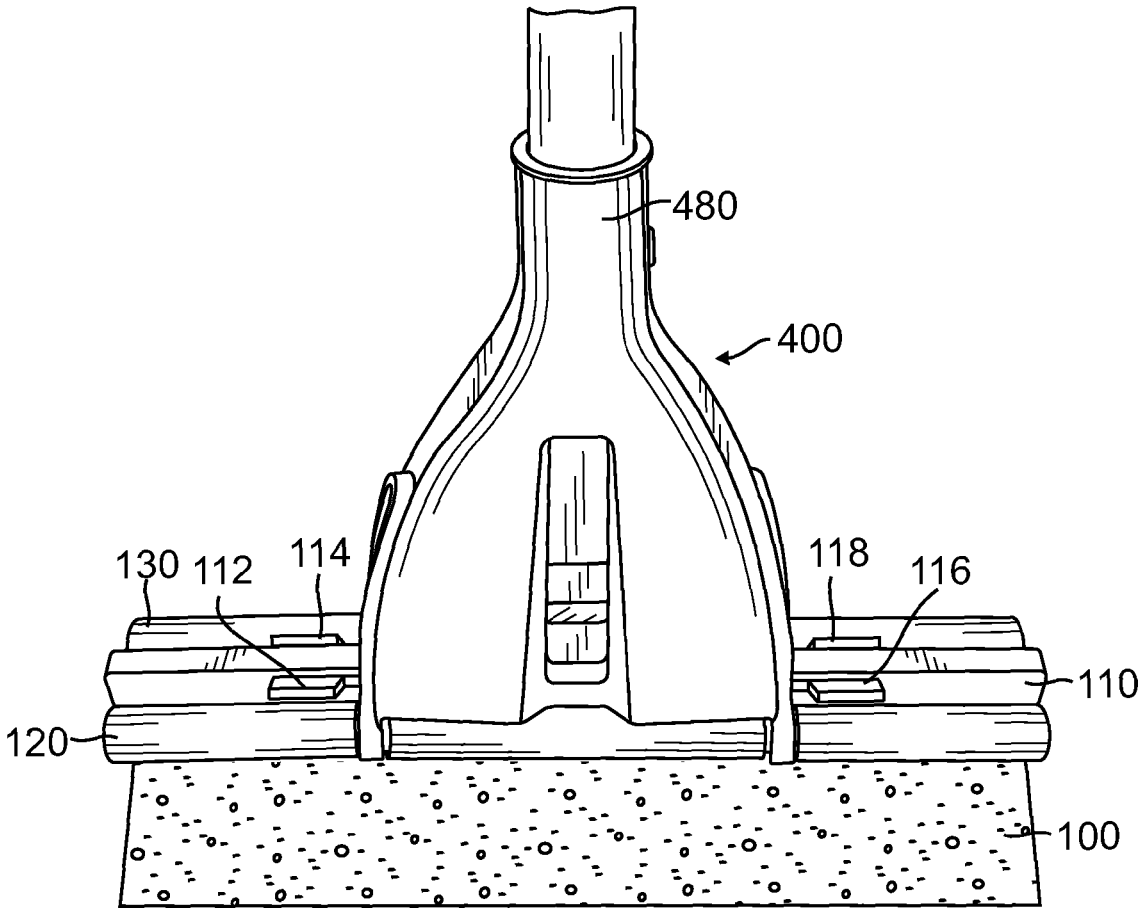
FIG. 2 is a closeup front elevational view of the sponge roller mop with the sponge retained in a plastic brace and retained between two rollers and also illustrating the innovative slit inside the middle of the housing which retains the operating mechanism of the present invention, and showing the rollers retained by the housing and the brace retained by the rollers, the brace in turn retaining sponge.
Figure 11:
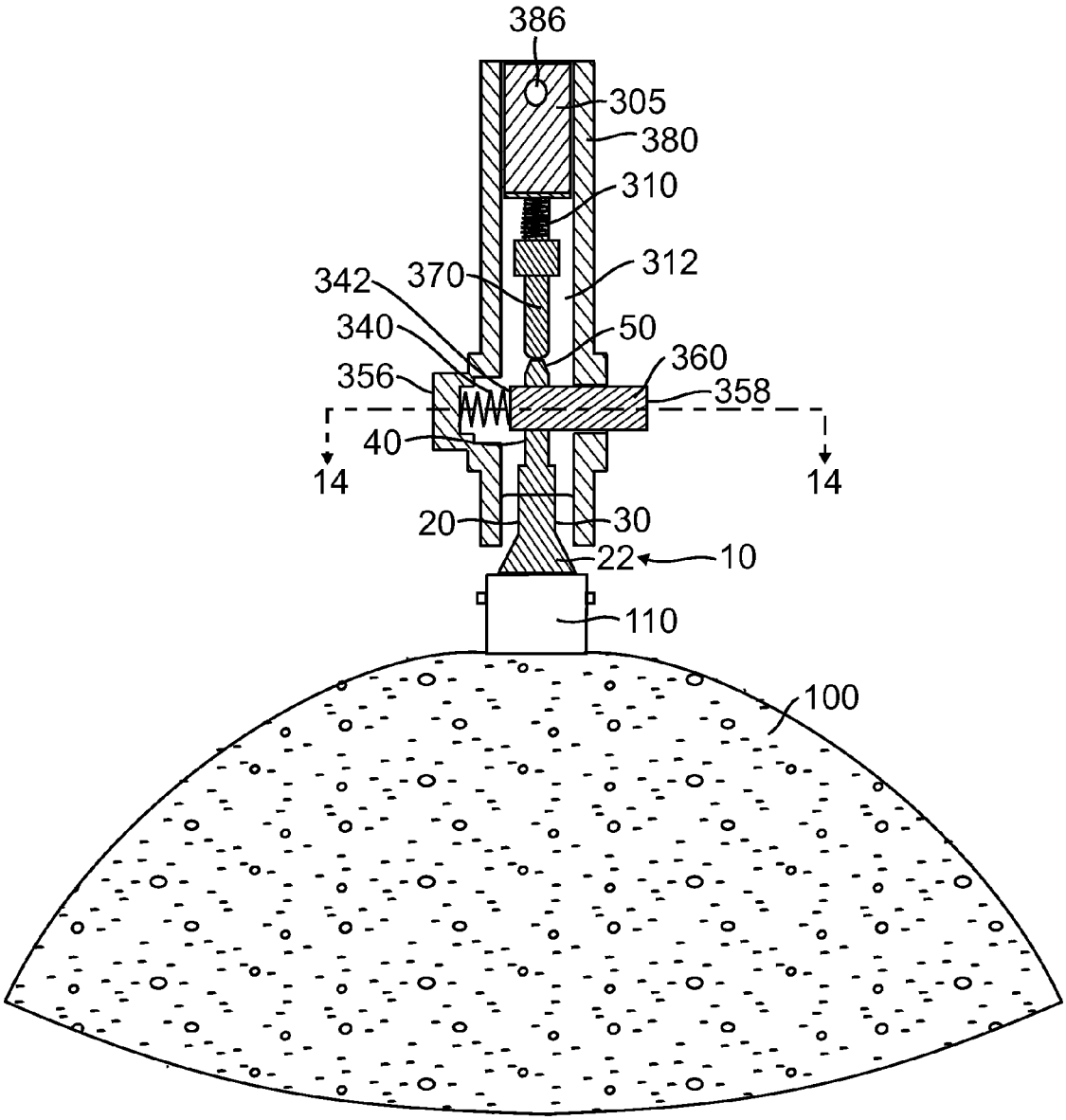
FIG. 11 is a side elevational view in partial cross-section showing that when the crown of the sponge pin is placed into the opening in the pushbutton, then the piston is caused to move upwardly and cause the vertical compression spring to go into the compressed condition. Also illustrated is the pushbutton having an exterior end and an interior end within a chamber within the housing where an opening in the pushbutton is aligned with the piston and a transverse compression spring affixed at one end to the interior wall of the pushbutton and at its opposite end affixed to an interior transverse wall. The transverse compression spring exerts a force to cause the pushbutton to move in the transverse direction so that the opening (or hole) is aligned with the piston to enable the crown of the sponge pin to be inserted through the hole and then a portion of the sidewall of the hole engages the sponge pin at a location between the crown and a lower section of the sponge pin to lock the sponge pin into the entire pushbutton mechanism.

Referring to FIG. 1 and FIG. 2, there is illustrated a sponge assembly for a roller mop 200 (see FIG. 11). The sponge assembly consists of a sponge 100 to which a brace 110 is molded so that the sponge 100 is compressed and retained by the brace 110. This portion of the invention is the subject of a prior issued patent by Fred I. Morad who is a co-inventor of that invention.

Figure 3:
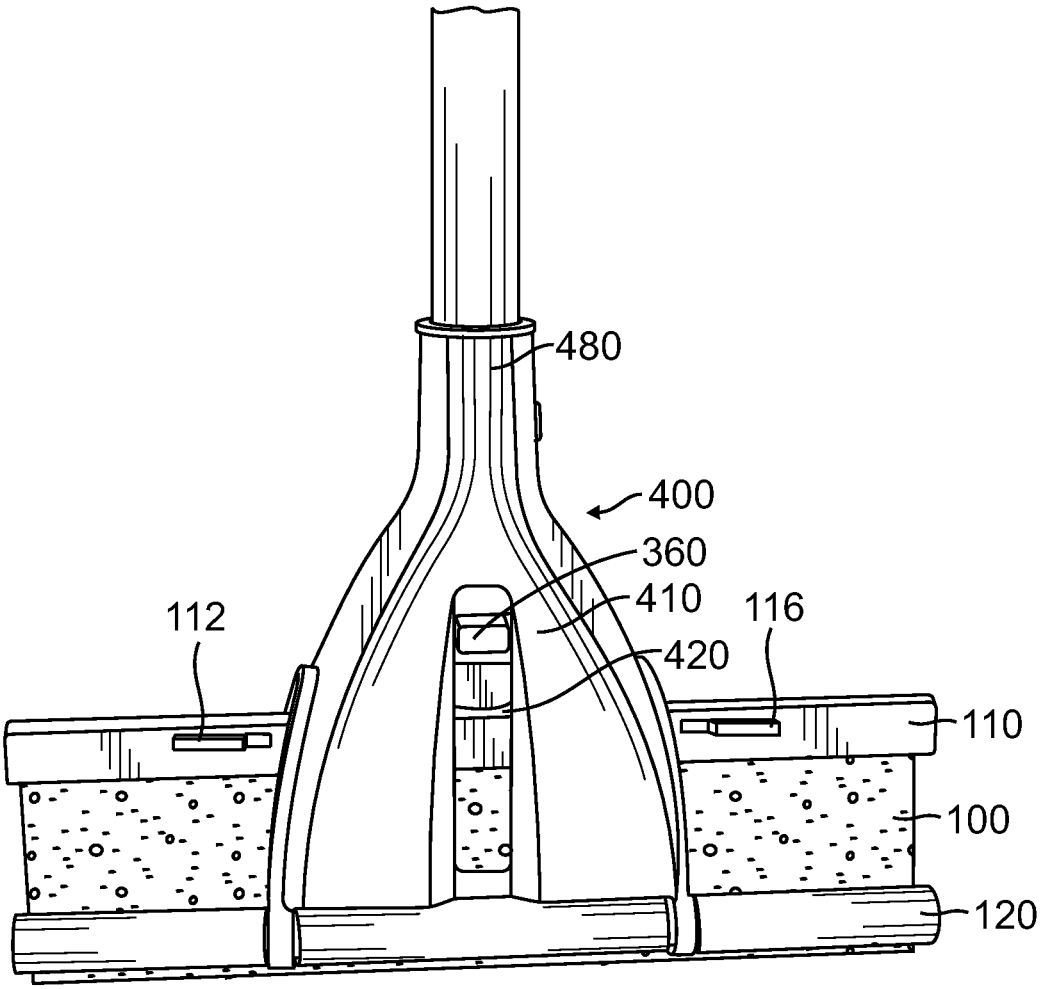
FIG. 3 is a closeup front elevational view of the sponge roller mop as is illustrated in FIG. 4, the front view illustrating the sponge mop squeezed between the rollers, with only one roller and the sponge mop retaining brace illustrated in FIG. 3.
Figure 4:
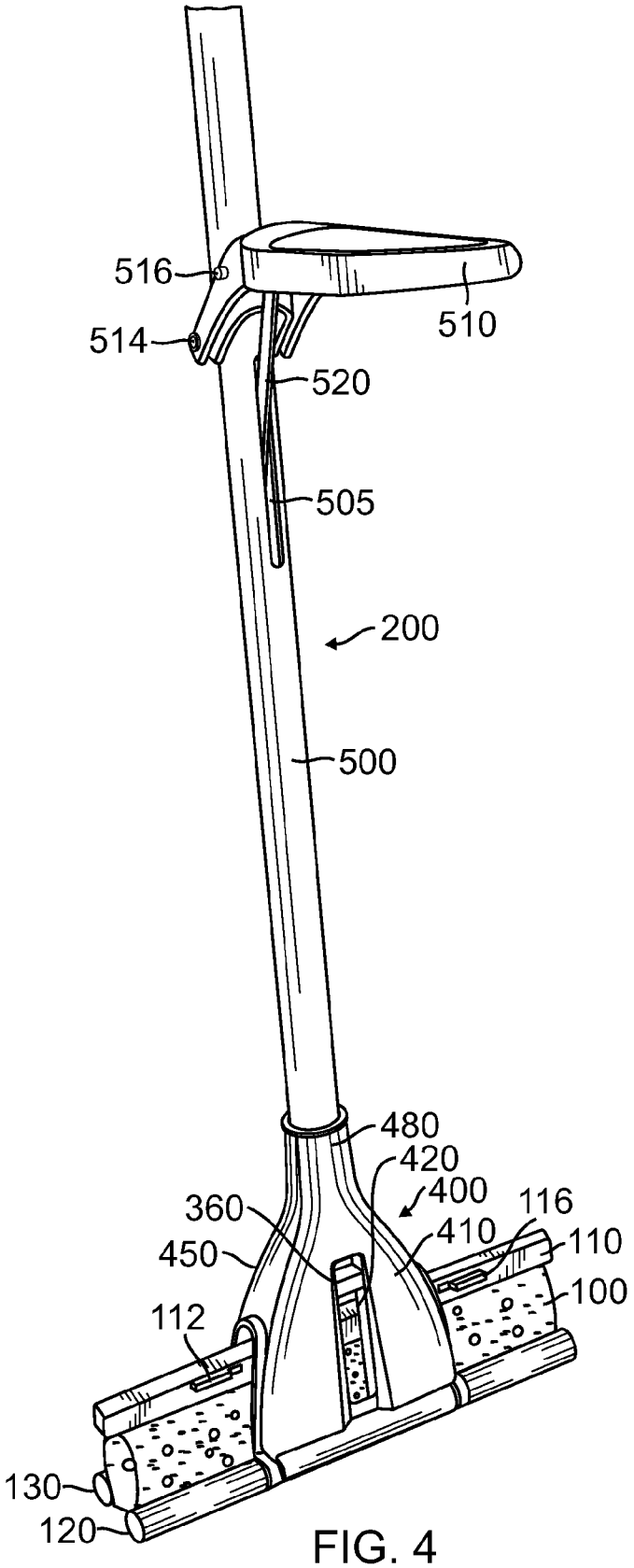
FIG. 4 is a front perspective view of the sponge roller mop with the quick release mechanism affixed to the sponge roller mop in a view similar to a portion of FIG. 3 but illustrating the lever wringer in the up activated position so that the sponge is pulled between the rollers to ring water out of the sponge.
Figure 5:
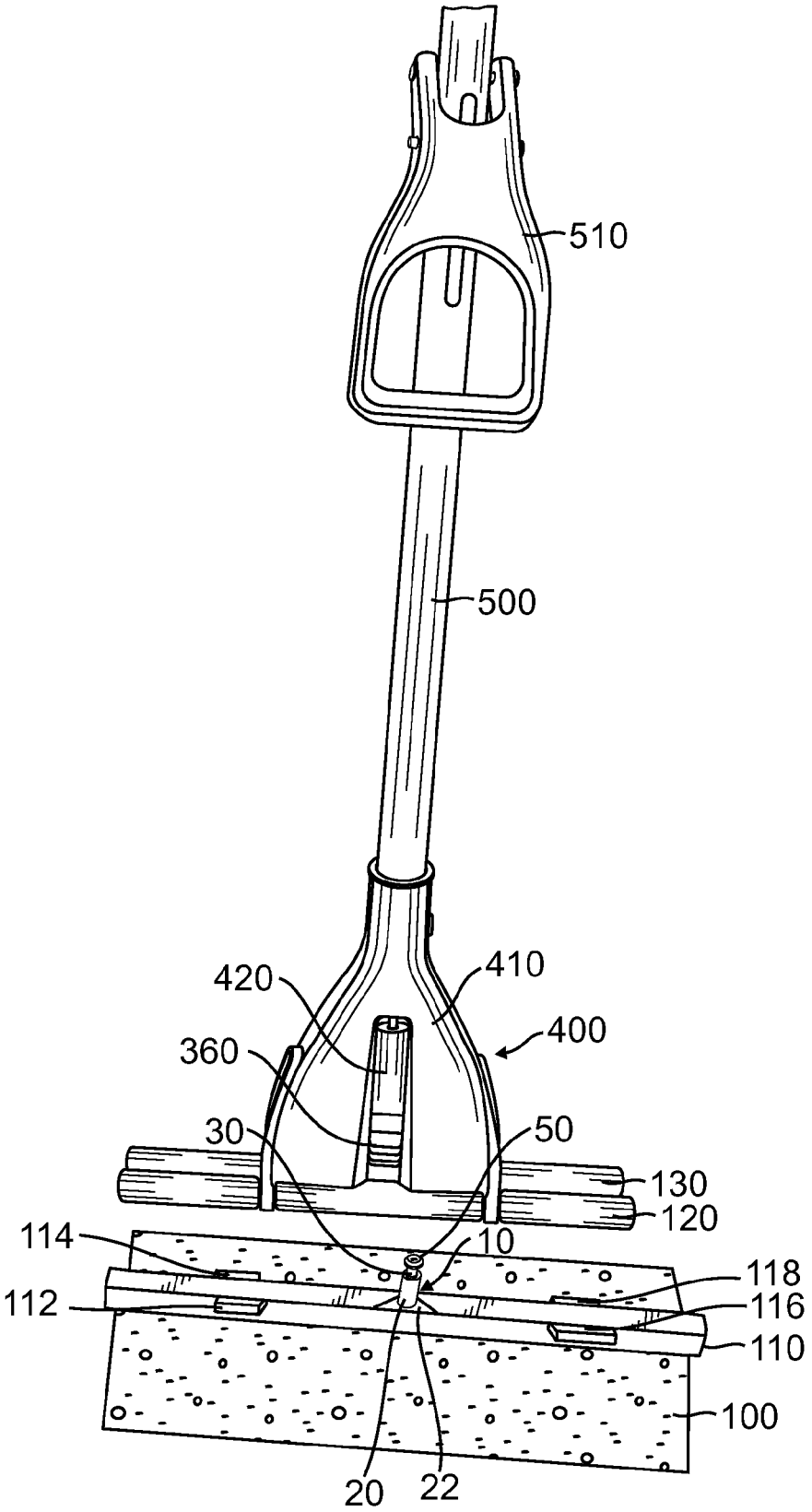
FIG. 5 is an exploded view showing the sponge itself retained by the brace (selected from the group consisting of plastic and metal), with the plastic brace, the sponge pin is molded onto the plastic brace and with a metal brace the sponge pin is pinched into the metal brace, showing the sponge pin removed from the roller mop which sponge pin is affixed to the plastic brace or metal brace as just described, with the roller mop and the activation mechanism elevated above the sponge.

Referring to FIGS. 1, 2, 3 and 4, there is illustrated a portion of a conventional roller mop which also includes the present invention. The conventional roller mop includes the sponge 100 which is molded to the brace 110 (if the brace is made of metal, then the sponge pin is pinched into the brace), which brace is retained between a pair of rollers 120 and 130. The roller mop in FIGS. 1 and 2 is shown in the use condition or unwrung condition where the mop 100 can be rolled against the floor to clean the floor. The lever handle (also referred to in this application as lever wringer) is illustrated in a first condition as illustrated in FIG. 4, the intermediate condition which is illustrated in FIG. 1 and in the third condition in FIG. 5 where the lever handle is against the mop handle to cause the brace to be removed from the rollers so that the sponge pin and brace and sponge can be ejected from the trigger mechanism. The mop handle is numbered 500 and the lever handle or lever wringer is numbered 510. The mop handle 500 has a slotted opening 505. The lever wringer 510 (or activation mechanism) is rotatably affixed to the mop handle 500 by a rivet 514. The rivet 514 extends through the entire width of the handle going from one end of the lever wringer to the other end of the lever wringer and a second rivet 516 which is connected to the rod 520 also goes through the entire width of the mop handle 500 and the rod 520. The interior rod 520 extends out of the slot 505 and is retained to the lever wringer 510 by the rivet 516. Therefore, the lever wringer is in three positions as discussed. When the lever wringer is in the position shown in FIG. 4, its highest position is when it is in the wrung position and the sponge is pulled through the rollers. Illustrated in FIG. 1 is the in-use condition where the lever wringer 510 is rotated downwardly so that the interior rod 520 moves downwardly so that the sponge is in the operating condition. The third orientation of the lever wringer is down against the handle as illustrated in FIG. 5 so that the brace (and affixed sponge) is removed from the rollers to facilitate the ejection of the brace by the present invention mechanism. The mop handle 500 also has a top cap 502 with an opening 504 to enable the mop to be hung from a nail or from other wall fixture.

Referring to FIGS. 2 and 5, the brace 110 includes four locking members, two front locking members 112 and 116 and two rear locking members 114 and 118. Traditionally, the rollers 120 and 112 have longitudinal ridges so that the front locking members 112 and 116 lock into the internal ridges of the front roller 120 and the rear locking members 114 and 118 lock into the ridges of the rear roller member 130. The purpose of these locking members is to keep the sponge from rotating out of alignment during mopping. What these four locking members (also called stopping members) do is to prevent the sponge from rotating during the mopping operation.

Referring to FIGS. 3 and 4, the sponge roller mop 200 is shown in the wrung condition where the sponge 100 is pulled between the two rollers 120 and 130 so that the sponge is wrung dry by being pulled between the two rollers. This is better illustrated in the side perspective view of FIG. 4. As illustrated in FIG. 4, the lever handle is illustrated away from the exterior mop handle 500 where the lever handle 510 is in the in-use condition.

In ordinary use, to remove a dirty sponge 100, the sponge is placed into the in-use condition as illustrated in FIGS. 1 and 2 and then the brace 110 is typically slid along a track between the two rollers so that the brace 110 is moved either left or right to remove the brace 110 from its position from the two rollers 120 and 130 and the sponge 100 is removed with the brace 110. Also, there is the alternative method in the prior art where the brace is retained by a J-hook mechanism and requires lifting. This is a conventional mechanism for removing the sponge from the rollers of the roller mop. The negative of this use is that the sponge 100 is usually in a used or dirty condition after extensive use in cleaning and therefore a user must use their hands to exert a force to pull the brace 110 and the sponge 100 in the transverse direction along the length of the two rollers 120 and 130 where the brace is typically resting on tracks between the two rollers so that the brace 110 can be pulled to the left or to the right to remove it from the rollers 120 and 130 and then a new sponge is replaced by sliding the brace along the tracks to replace the dirty sponge and its brace with the new brace and sponge which shall be placed in the same position as the original dirty sponge and brace. While this is traditionally the way the roller sponge mop has been used, the major negative of this is that a user, even if they wear gloves, must handle the filthy used sponge 100. Therefore, it is possible for them to come in contact with dirt and germs from the sponge which has picked up dirt and debris during its moping operation. Therefore, the present invention is a significant improvement whereby the brace and the sponge can be released without requiring a user to handle the dirty sponge during the release process.

Referring to FIG. 5, there is illustrated an exploded view of some of the innovations of the present invention illustrating the lower portion of the sponge mop with the lever handle 510 in the releasing condition where the lever handle 510 is adjacent the mop handle which facilitates the brace 110 and the locking members or stopper members 112, 116, 114 and 118 being pushed away from the rollers 120 and 130 to thereby facilitate the ejection of the sponge pin 10 by pressing the pushbutton 360 of the present invention. The components of the sponge pin 10 will also be described later on in the application.

Figure 6:
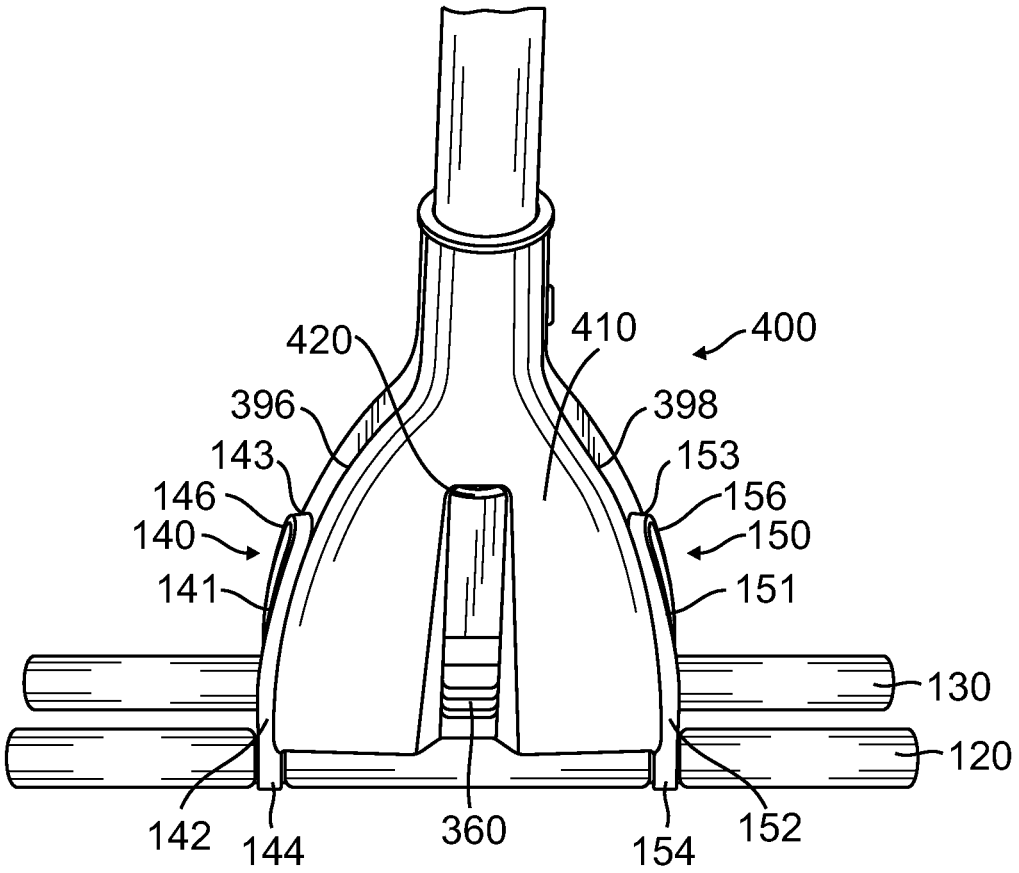
FIG. 6 is a closeup front elevational view showing the quick release activation mechanism of the present invention within the housing and affixed to the rollers with the sponge and retaining brace removed from the rollers.

FIG. 6 is a closeup front elevational view showing the quick release activation mechanism of the present invention within the housing and affixed to the rollers 120 and 130 with the sponge 100 and the sponge retaining brace 110 removed from the rollers 120 and 130. The rollers 120 and 130 are retained together by a first joining member 140 and a second joining member 150. The first joining member 140 has a first front arm 142 having a first front engaging member 144 retaining a portion of the front roller 120 and a first rear arm 146 having a comparable first rear engaging member comparably retaining a portion the rear roller 130. The first front arm 142 and the first rear arm 146 are separated by a gap 141 and joined by a first upper section 143, the first joining member 140 configured to rest adjacent to and molded to a first sidewall 396 of a housing 400. Referring further to FIG. 4 as well as FIGS. 5 and 6, the front 410 of the housing 400 is visible and the rear 450 of the housing 400 is also visible. Therefore, access to the release mechanism button 360 is easily facilitated by the cutout 420 in the front 410 of housing 400. In addition, when the mop is in the wringing position as shown in FIG. 4, the cutout 420 enables the pushpin 360 to move vertically within the slot 420 as the entire trigger mechanism is raised when the lever is in the wringing condition as illustrated in FIG. 4 so that the mop can be wrung to wring water out of the mop 100. The second joining member 150 has a second front arm 152 having a second front engaging member 154 retaining a portion of the front roller 120 and a second rear arm 146 having a comparable second rear engaging member comparably retaining a portion the rear roller 130. The second front arm 152 and the second rear arm 156 are separated by a gap 151 and joined by a second upper section 153, the second joining member 150 configured to rest adjacent to and molded to a second sidewall 398 of a housing 400 which will be described later in this application. The gaps 141 and 151 enable the sponge 100 to be pressed between the rollers 120 and 130 as illustrated in FIG. 4.

Figure 7:
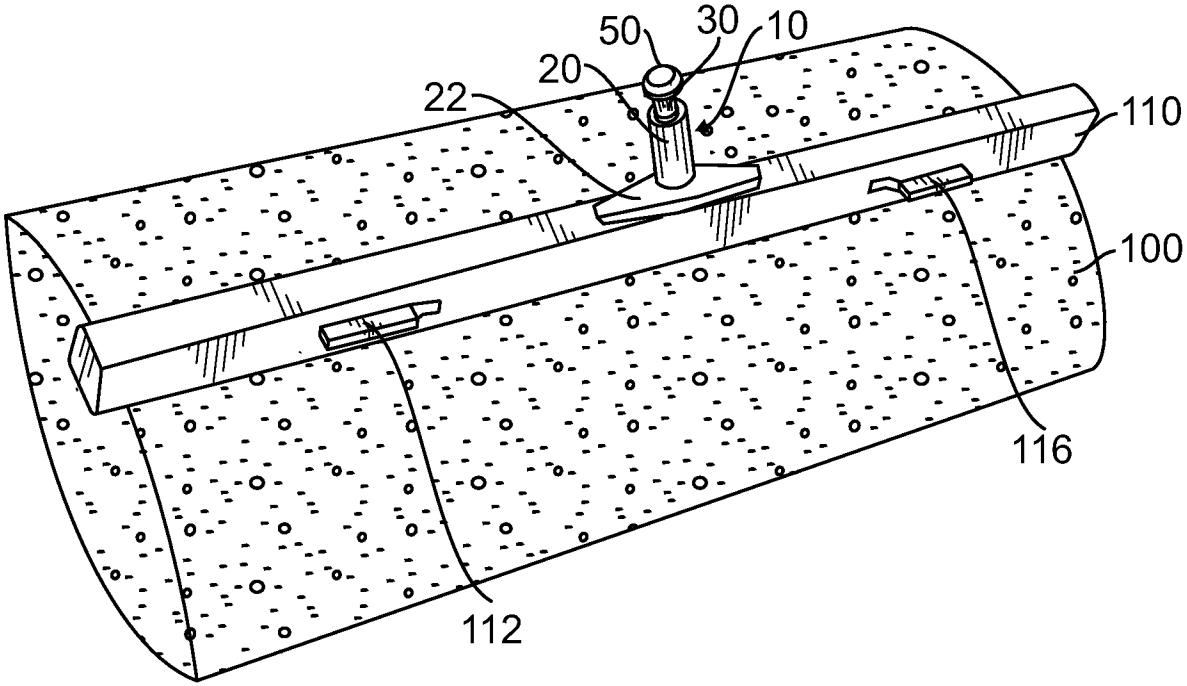
FIG. 7 is a closeup top perspective view of the brace which is affixed to and retains the sponge. Also disclosed is the sponge pin molded into the brace. The sponge pin is shown as a three section piece. The sponge pin includes a large cylindrical section with a widened base molded to the brace. A more narrow cylindrical section extends from the large cylindrical section to a narrowest cylindrical section which terminates in a widened collar. The entire sponge pin is illustrated in greater detail in FIG. 12.

Referring to FIG. 7, there is illustrated a closeup top perspective view of the brace 110 which is affixed to and retains the sponge 100. Also disclosed is the sponge pin 10 molded into the brace 110. The sponge pin 10 is shown as a three section piece which is illustrated in greater detail in FIGS. 11, 12 and 13. Referring to FIGS. 5, 7, 11, 12 and 13, the sponge pin 10 includes a large cylindrical section 20 with a widened base 22 molded to the brace 110. A more narrow cylindrical section 30 extends from the large cylindrical section 20 to a narrowest cylindrical section 40 (best illustrated in FIG. 12) which terminates in a widened collar 50.

Figure 8:
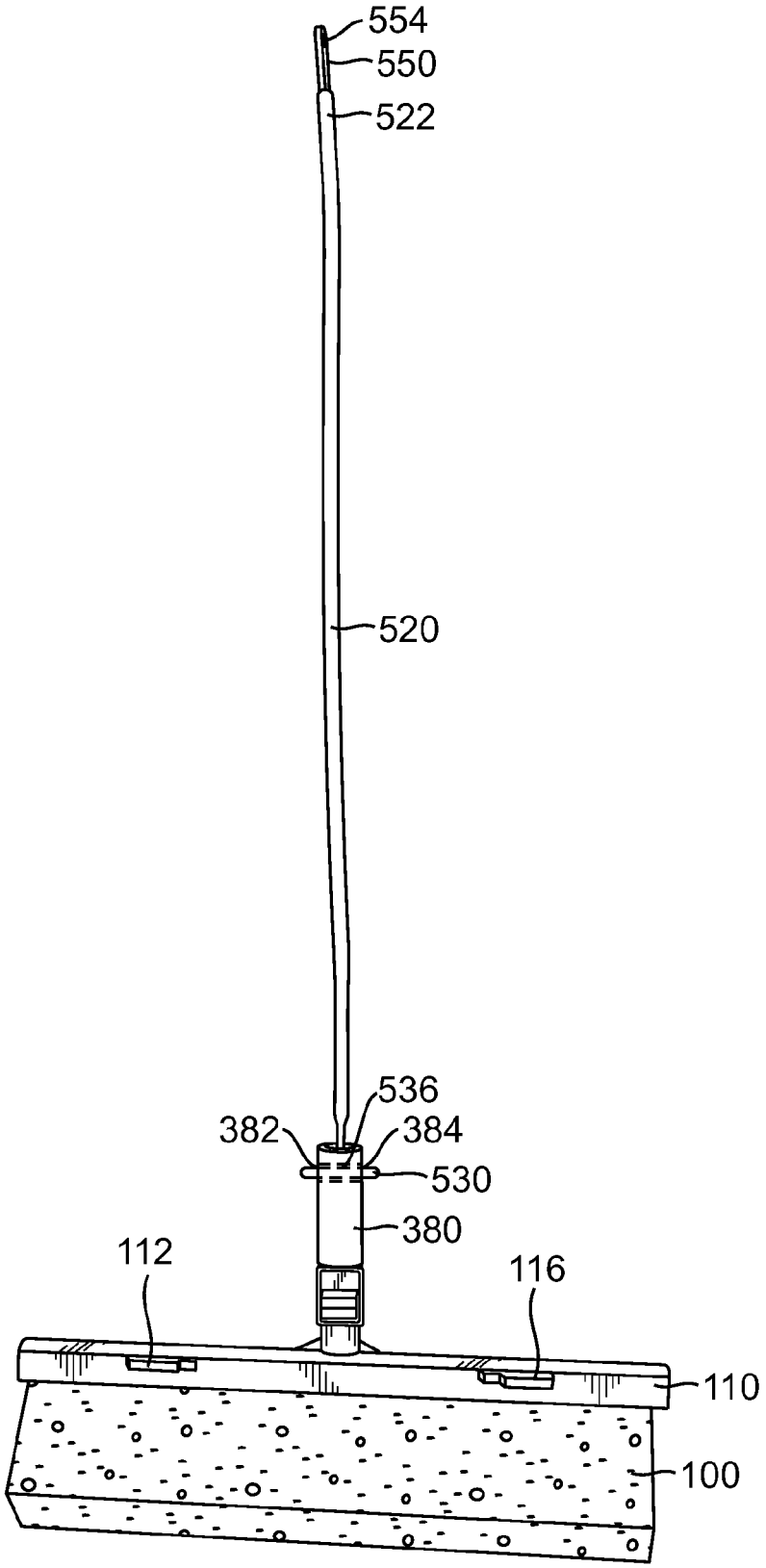
FIG. 8 is a front elevational view of the sponge assembly retained by the brace and retained with a mop retaining mechanism retained in the rod but without the housing which covers the quick release mechanism and the cover of the rod.

Referring to FIG. 8, there is illustrated a front elevational view of the sponge 100 and brace 110 with the rollers and retaining members removed to better illustrate the sponge pin affixed to the brace 110 and retained with a mop retaining mechanism having a cylindrical housing 380 (described in detail later in this application) retaining an interior rod connector 305. The exterior mop handle 500 retained with the rod 520 retained at its bottom end by a pin 530 extending through aligned openings 382 and 384 in the mop retaining cylindrical housing 380 and the rod having an aligned opening 536 in the lower end of the interior rod 520. Although drawn longer, the interior rod 520 in fact ends at the location of the lever ringer 510. Referring to FIG. 4, the exterior mop handle 520 has a slotted opening 505 and the rod 520 has a pinched end 550 which has a rivet hole 554 through which rivet from the lever handle as previously discussed extends to enable the rod to move when the lever wringer is moved to the three different orientations, the in-use, the wringing position and the ejection position.

Figure 9:
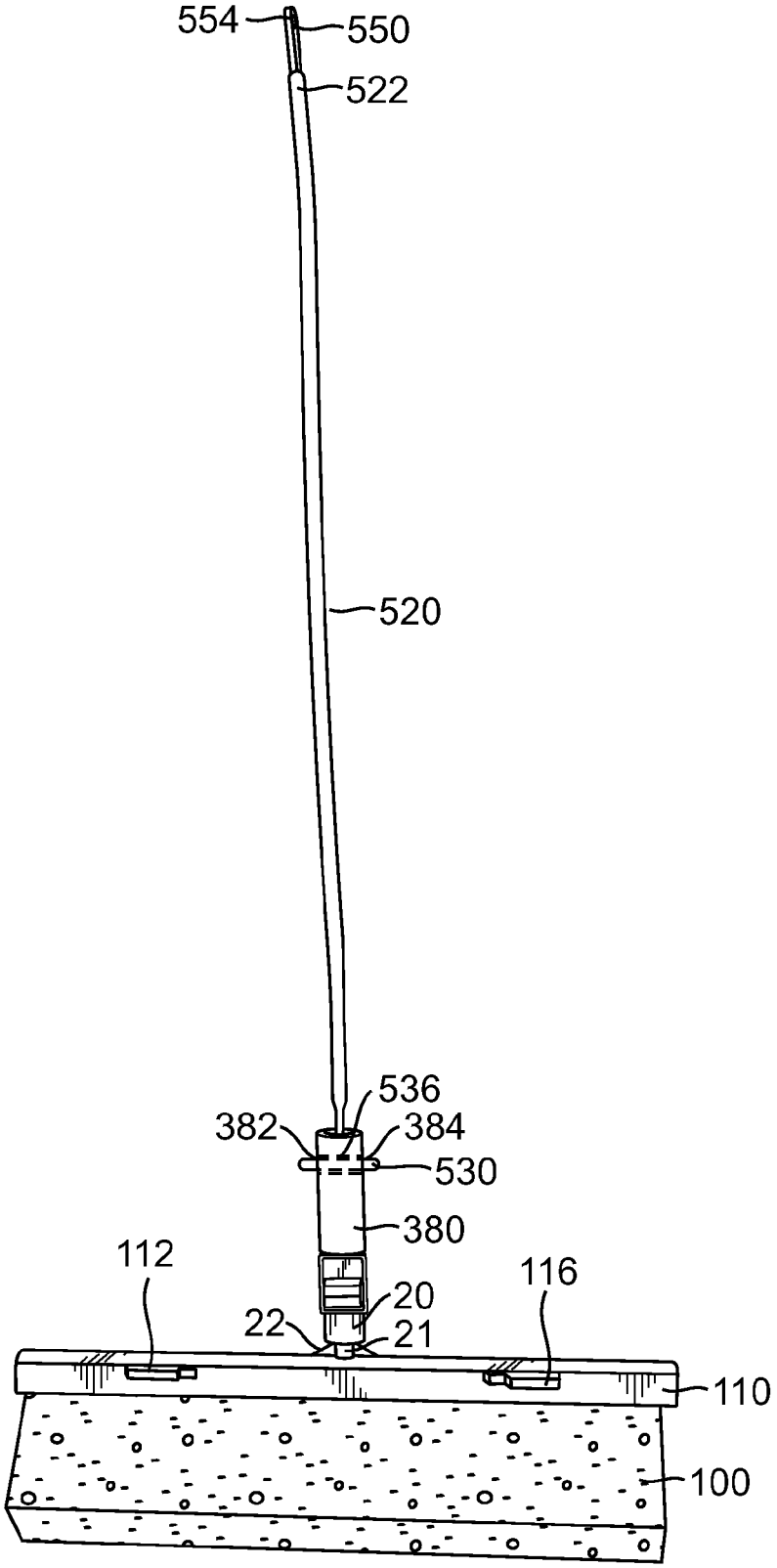
FIG. 9 is a similar view as illustrated in FIG. 8 a but with the lower large cylindrical section of the sponge pin at the brace being illustrated.
Figure 10:
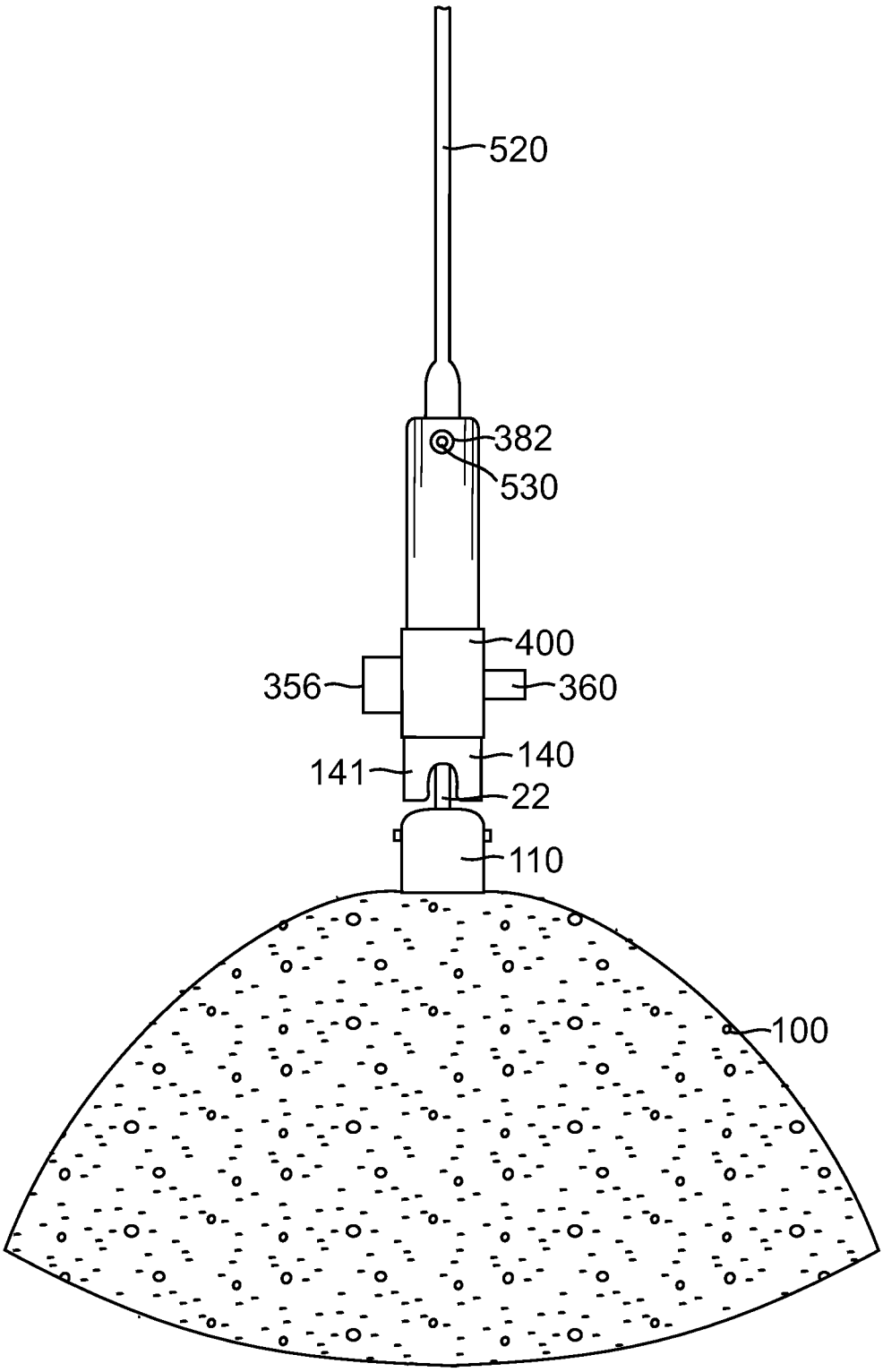
FIG. 10 is a side elevational view of the sponge and the covering on a portion of the pushpin with a portion of the pushpin inserted into the pushpin activation mechanism and an upper portion of the interior shaft affixed to the interior rod which forms part of the handle of the mop.

Referring to FIG. 9, there is illustrated a front elevational view similar to FIG. 8 illustrating the sponge 100 and brace 110 with the rollers and retaining members removed to better illustrate the sponge pin 10 affixed to the brace 110, with a lower interior portion 21 within the widened base portion 22 of the large cylindrical section 20 also retained by the brace 110 and retained with a mop retaining mechanism having cylindrical housing 380 (described in detail later in this application) rotatably retaining an interior rod 520 (concealed by handle 500) by a pin 530 extending through aligned openings 382 and 384 in the mop retaining cylindrical housing 380 and aligned openings (not shown) in the lower end of the interior handle rod.

Figure 12:
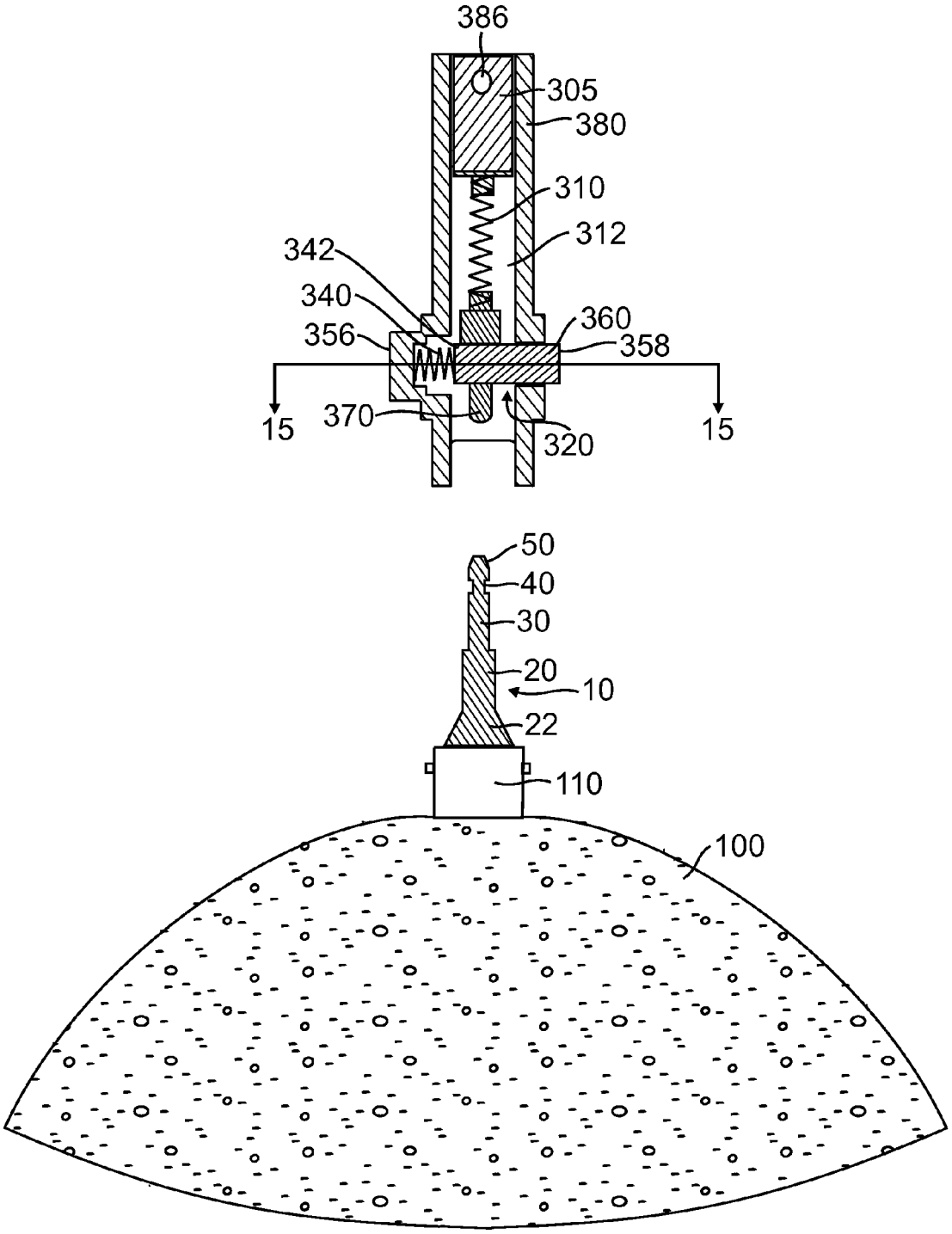
FIG. 12 is a side elevational view of the sponge and retaining brace and a cross-sectional view of the trigger mechanism which includes a vertical wall with a rod connector with the vertical spring in the released condition exerting a downward force on the piston to cause the crown to be ejected from the trigger mechanism due to the fact that a transverse force on the pushbutton overcomes the force of the transverse spring to cause the opening in the pushbutton to be aligned with the crown of the sponge pin and the piston to facilitate the ejection of the sponge pin from the trigger mechanism.

Referring to FIG. 12, there is illustrated one key component of the present invention which is the sponge pin 10 which is molded as one piece and contains three sections molded together. The lowermost section 20 is the largest cylindrical piece and is molded to a widened section which is molded integral with the brace 110 which holds the sponge 100. A second intermediate section 30 has a diameter that is slightly narrower than the lowermost section 20. The third section 40 has a diameter that is narrower than the second intermediate section 30 and the third section 40 terminates in a locking crown 50. There is a gap between the locking crown 50 and a second intermediate section 30 so that a piece can be inserted at the location of the third section 40 and the crown 50 so that it will serve to lock the sponge pin 10 to the rod retaining mechanism or mop retaining mechanism.

Figure 16:
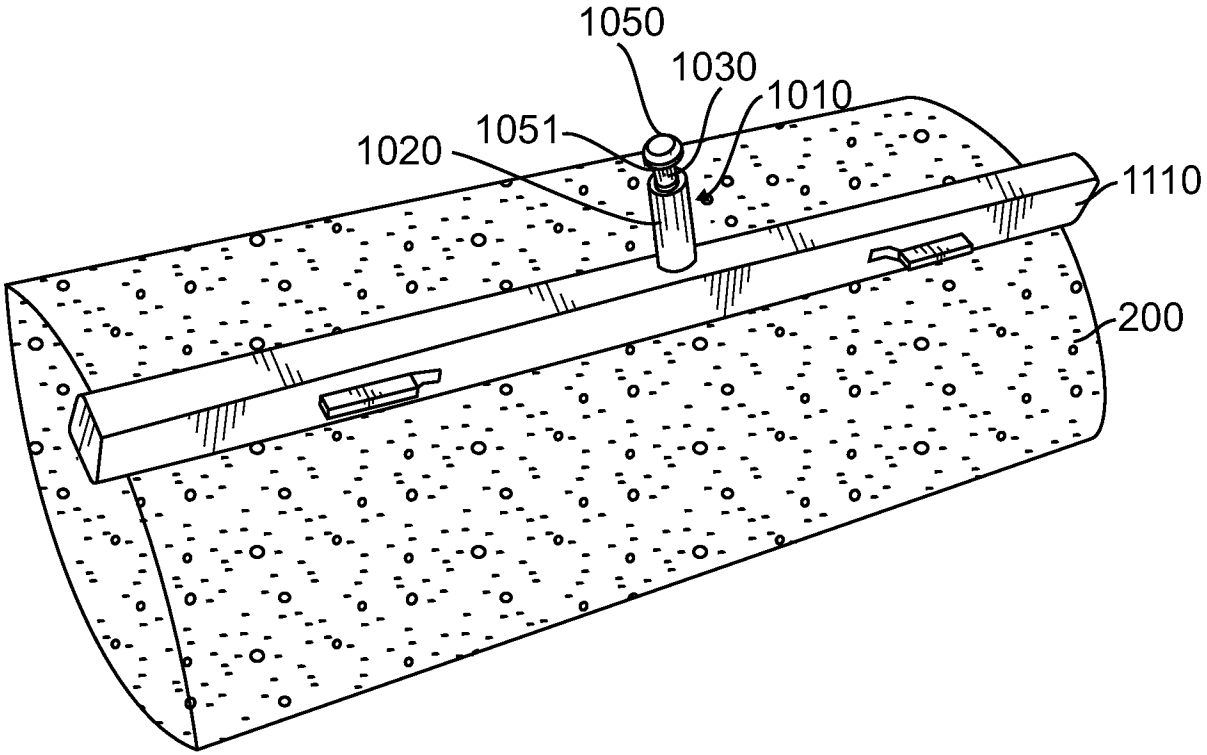
FIG. 16 is a close-up top perspective view of the brace which is affixed to and retains the sponge. Also disclosed is an alternative variation of the sponge pin molded to the brace. The sponge pin is shown having a first section molded to the brace, a second narrow section extending from the first section and the second section terminating in a crown having a lower surface.

It is also within the spirit and scope of the present invention to have variations on the connector pin. Specifically, as illustrated in FIG. 16, the connector pin 110 has a first section 1020 molded to the brace 1100 which retains sponge 2000. The connector pin 1010 has a second narrower section extending from the first section 1030 extending from the first section 1020. The second section 1030 ends in a crown 1050 having a lower surface 1051. The operation is the same as illustrated in the previous figures with the crown 150 inserted through the opening 330 of the pushbutton 60 to be locked on the sidewall 332 as described for FIGS. 10-15.

Referring to FIGS. 10, 11, 12, 13, 14 and 15, there are illustrated different portions of the trigger mechanism numbered 320 in both the unactivated and activated condition. Referring to FIG. 11, there is a cross-sectional view showing the trigger release mechanism in the unactivated or pin retaining condition. The trigger release mechanism includes a vertical spring 310 as shown in the compressed condition in FIG. 11. The upper end of the spring 310 is affixed to internal rod connector 305 also located within interior chamber 312 of housing 380. The essence of the trigger mechanism 320 is that it has a transverse portion which has a transverse pushbutton 360 which includes an opening 330 with a sidewall 332 that is resting within the interior chamber 312 of the trigger mechanism housing 380. A transverse compression spring 340 which is retained at a distal end at the interior 341 of transverse wall 356 and retained at its proximal end adjacent an interior end 342 of pushbutton 360. In what is considered the unactivated condition as illustrated in FIG. 11, the compression spring 340 exerts a transverse force on the pushbutton 360 which has a distal end 358. The compression force of spring 340 pushes the pushbutton 360 in a transverse direction so that when the sponge pin 10 is inserted into the interior chamber 312 of housing 380, the crown 50 of sponge pin 10 is inserted through opening 330 and the force of horizontal spring 340 causes the sidewall 332 to be lodged between the lower portion of crown 50 and an upper portion of cylindrical section 30 and rest against narrowest cylindrical section 40 so that the sponge pin 10 is locked in place within opening 330. As a result, the sponge pin 10 is pushed upwardly so that the crown 50 is pushed against the piston 370 which is retained in the interior 312 of housing 380 and to cause vertical spring 310 to go into a compressed condition as illustrated in FIG. 11. Within the housing 380 is a rod connector 305 which has an opening 386 through which the pin 530 is inserted. Opening 386 is aligned with openings 382 and 384.

Figure 13:
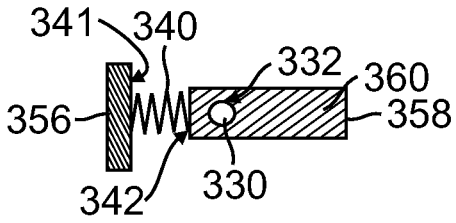
FIG. 13 is a top cross-sectional view illustrating the pushbutton and the opening within the pushbutton and sidewall within the opening, the pushbutton having a distal end and an internal transverse end within the chamber of the trigger mechanism, a transverse compression spring retained between a proximal end of the pushbutton and a transverse wall.
Figure 14:
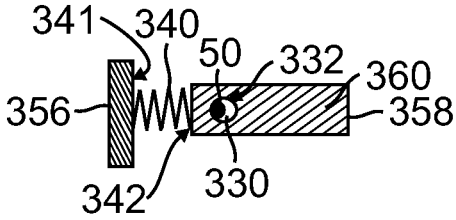
FIG. 14 is a cross-sectional view taken along Line 14-14 of FIG. 11 illustrating the crown locked within an opening in the pushbutton to prevent the sponge pin from being ejected from the mop retaining mechanism.
Figure 15:
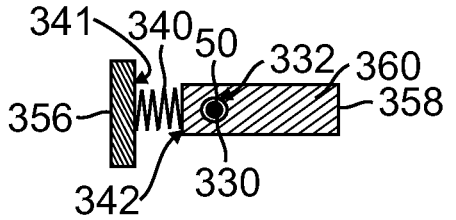
FIG. 15 is a cross-sectional view taken along Line 15-15 of FIG. 12 illustrating that a transverse force on the pushpin causes the transverse spring to be compressed so that the opening within the pushbutton is aligned with the piston and with the crown of the sponge pin to enable a force from the vertical spring to cause the vertical force of the piston on the top of the crown of the sponge pin to cause the sponge pin and its associated brace and sponge to be ejected from the trigger mechanism.

Referring to the cross-sectional view of FIG. 13, there is shown with no additional components the transverse pushbutton 360 having the distal end 358, the opening 330 and sidewall of the opening 332, the compression spring 340 retained against the interior wall 341 of transverses wall 356 and against interior-most wall (proximal wall) 342 of pushbutton 360. Further referring to the cross-sectional view of FIG. 14 take along Line 14-14 of FIG. 11, the pushbutton 360 is illustrated where the crown 50 has now been inserted through opening 330 and wall 332 of opening 330 is lodged between the crown 30 and cylindrical section 30 and against narrowest cylindrical section 40 of sponge pin 10. The spring 340 is in the uncompressed state having pushed the pushbutton in a transverse direction so that the retaining pin 10 is locked against the sidewall 332 of opening 330.

In order to convert to the activated condition, referring to FIG. 12, the pushbutton 360 is pushed at its distal end 358 so that it moves in a transverse direction to convert the compression spring 340 from its uncompressed condition illustrated in FIG. 11 to its compressed condition illustrated in FIG. 12. As a result, the opening 330 is moved transversely so that the sidewall 332 of the opening no longer engages the sponge pin 10 and is no longer between crown 50 and cylindrical section 40 adjacent narrow section 30 of sponge pin 10 so that the sponge pin is no longer in the locked condition and then the downward compression force of spring 310 forces the sponge pin 10 in a downward direction so that it is released from the trigger mechanism so that the sponge pin 10 and its attached molded brace 110 and sponge 100 are removed from the trigger mechanism and released so that it can be replaced with a new sponge pin, brace and sponge.

To keep the operating assembly safe from dirt and debris, the trigger mechanism 320 is retained within a housing 400 which has a body 410 with a vertical cutout 420 through which the pushbutton 360 is accessible. The housing 400 is retained above first roller 120 and second roller 130 by first joining member 140 and second joining member 150 as previously described.

Referring to FIG. 4, the front 410 of housing 400 is visible and the rear 450 of housing 400 is also visible. Therefore, access to the release mechanism button 360 is easily facilitated by the cutout 420 in the front surface 410 of housing 400. The housing itself has a collar 480 (see FIGS. 1 through 4) which retains the exterior mop handle 500 which has the lever mechanism 510 by which the sponge 100 is pulled upwardly as illustrated in FIGS. 3 and 4 to wring the sponge dry and released as illustrated in FIGS. 1 and 2 so that the sponge is in operating condition.

Referring to FIG. 5, the sponge 100 is released from the trigger mechanism 320 so that the sponge is removed from the retaining mechanism without a person having to touch the dirty sponge 100.

Therefore, through use of the present invention, a user will not have to touch a dirty sponge but instead can have the mechanism as shown through the present invention release the sponge so that it can be discarded without having to touch the sponge and thereafter insert a new sponge with a sponge pin inserted into the housing as already described to have the crown 50 retained within the trigger mechanism 320.

Figure 17:
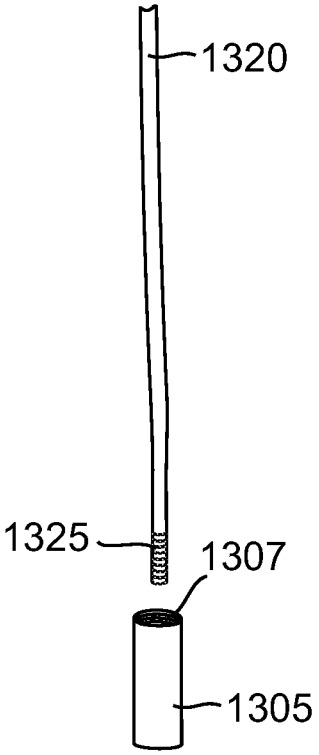
FIG. 17 is an exploded view of an alternative variation of the elongated rod where the elongated rod has male threads on its lower surface to be received in a connector rod having mating female threads in its interior surface.
Figure 18:
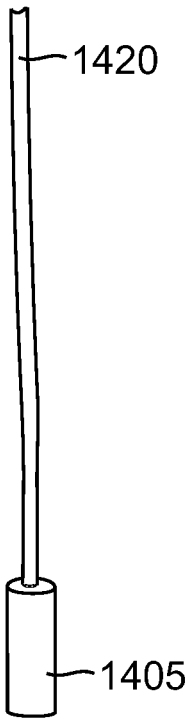
FIG. 18 is a side elevational view of another alternative variation of the elongated rod made in one piece where the elongated rod and connector rod (the connector rod portion fitting inside the housing of the trigger mechanism) are made in one piece.

It is also within the spirit and scope of the present invention to have variations in the combination of the elongated rod and the connector rod. Specifically, in addition to the variation already described, referring to FIG. 17, there is illustrated an alternative variation of the elongated rod which is numbered 1320 and the rod connector which is numbered 1035 which is housed in housing 380. The elongated rod 1320 has threaded members 1325 on its lower end received in female threads 1307 within rod connector 1305. Further, referring to FIG. 18, the connector rod and the rod connector can be formed in one piece with the connector rod numbered 1420 but integral in one piece with the rod connector 1405, which rod connector portion is retained within housing 380.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A sponge roller mop including a sponge retained by a brace, a first roller and a spaced apart second roller, a mop handle surrounding an interior elongated rod, a lever wringer rotatably engaged to the elongated mop handle and connected to the elongated rod, the sponge mop comprising:

a. a sponge pin molded onto the brace so that the sponge pin extends away from the brace, the sponge pin having a first section integral with a wide section molded onto the brace, a second narrower section, a third narrowest section and a crown having a lower surface, a gap between the lower surface of the crown and the second narrower section, the gap centered by the third section;

b. the brace including a first front stopping member and a spaced apart second front stopping member engaging the first roller and a first rear stopping member and a spaced apart second rear stopping member engaging the second roller;

c. a trigger release mechanism including an exterior vertical housing surrounding an interior vertical chamber having a fixed rod connector, a first movable vertical piston and a first vertical compression spring between the fixed rod connector and the first movable vertical piston, a transverse housing surrounding a transverse interior chamber, a pushbutton extending into the transverse interior chamber, the pushbutton including a distal end and a proximal end within the transverse interior chamber, the pushbutton having an opening and an opening circumferential sidewall extending through the pushbutton at a location adjacent its proximal end, the transverse housing including a transverse wall with an interior surface, a transverse compression spring retained between the interior surface of the transverse wall and the proximal end of the pushbutton;

d. the sponge pin inserted through the opening in the pushbutton and the transverse compression spring in an uncompressed condition exerting a force causing the circumferential sidewall of the opening to be lodged in the gap of the sponge pin to lock the sponge pin and causing the first vertical compression spring to be in a compressed condition;

e. the lever wringer is moved to a position to disengage the brace from the rollers and then a transverse force at the distal end of the pushbutton overcomes the force of the transverse compression spring causing the opening in the pushbutton to move and disengaging the sponge pin from the circumferential sidewall of the opening in the pushbutton, the crown is aligned with the movable piston and a force of the vertical compression spring causes the sponge pin to be ejected by the trigger mechanism also ejecting the brace and the sponge; and f. the trigger mechanism is retained within the housing which has a body with a vertical cutout through which the pushbutton is accessible.

2. A sponge roller mop including a sponge retained by a brace, a first roller and a spaced apart second roller, a housing retained above the first roller and second roller and retaining members retaining the first roller and second roller together below the housing, a mop handle surrounding an interior elongated rod with a portion of the rod extending through the mop handle to an activation member, the sponge mop comprising:

a. a sponge pin molded onto the brace so that the sponge pin extends away from the brace, the sponge pin having at least a first section molded onto the brace, a second narrower section extending from the first section, the second narrower section terminating in a crown having a lower surface, a gap between the lower surface of the crown and an upper portion of the first section of the sponge pin;

b. the brace including a first front stopping member and a spaced apart second front stopping member engaging the first roller and a first rear stopping member and a spaced apart second rear stopping member engaging the second roller;

c. a trigger release mechanism including an exterior vertical housing surrounding an interior chamber having a rod connector, a first movable vertical piston and a first vertical compression spring between the fixed rod connector and the first movable vertical piston, a transverse housing surrounding a transverse interior chamber, a pushbutton extending into the transverse interior chamber, the pushbutton including a distal end and a proximal end within the transverse interior chamber, the pushbutton having an opening and an opening circumferential sidewall extending through the pushbutton at a location adjacent its proximal end, the transverse housing including a transverse wall with an interior surface, a transverse compression spring retained between the interior surface of the transverse wall and the proximal end of the pushbutton;

d. the sponge pin inserted through the opening in the pushbutton and the transverse compression spring in an uncompressed condition exerting a force causing the circumferential sidewall of the opening to be lodged in the gap of the sponge pin to lock the sponge pin and causing the first vertical compression spring to be in a compressed condition;

e. the activation mechanism is moved to a position to disengage the brace from the rollers and then a transverse force at a distal end of the pushbutton overcomes the force of the transverse compression spring causing the opening in the pushbutton to move and disengaging the sponge pin from the circumferential sidewall of the opening in the pushbutton, the crown is aligned with the movable piston and a force of the vertical compression spring causes the sponge pin to be ejected by the trigger mechanism also ejecting the brace and the sponge; and f. the trigger mechanism is retained within the housing which has a body with a vertical cutout through which the pushbutton is accessible.

3. The sponge roller mop in accordance with claim 2, further comprising: the elongated rod and the rod connector are formed in one piece.

4. The sponge roller mop in accordance with claim 2, further comprising: the elongated rod has male threads at its lower end and the rod connector has internal female threads to receive the male connector from the elongated rod.

5. The sponge roller mop in accordance with claim 2, further comprising: the elongated rod has a lower section with an opening and the rod connector has an opening extending therethrough to enable a pin to extend through a first opening in the elongated vertical housing through the opening in the lower portion of the elongated rod and through the second opening in the elongated vertical housing.

6. A sponge roller mop including a sponge retained by a brace, a first roller and a spaced apart second roller, a housing retained above the first roller and second roller and retaining members retaining the first roller and second roller together below the housing, a mop handle surrounding an interior elongated rod with a portion of the rod extending through the mop handle to an activation member, the sponge mop comprising:

a. a sponge pin molded onto the brace so that the sponge pin extends away from the brace, the sponge pin having at least a first section molded onto the brace, a second narrower section extending from the first section, the second narrower section terminating in a crown having a lower surface, a gap between the lower surface of the crown and an upper portion of the first section of the sponge pin;

b. a brace including stopping members which retain the brace between the first roller and the second roller;

c. a trigger release mechanism including an exterior vertical housing surrounding an interior chamber having a rod connector, a first movable vertical piston and a first vertical compression spring between the fixed rod connector and the first movable vertical piston, a transverse housing surrounding a transverse interior chamber, a pushbutton extending into the transverse interior chamber, the pushbutton including a distal end and a proximal end within the transverse interior chamber, the pushbutton having an opening and an opening circumferential sidewall extending through the pushbutton at a location adjacent its proximal end, the transverse housing including a transverse wall with an interior surface, a transverse compression spring retained between the interior surface of the transverse wall and the proximal end of the pushbutton;

d. the sponge pin inserted through the opening in the pushbutton and the transverse compression spring in an uncompressed condition exerting a force causing the circumferential sidewall of the opening to be lodged in the gap of the sponge pin to lock the sponge pin and causing the first vertical compression spring to be in a compressed condition;

e. the activation mechanism is moved to a position to disengage the brace from the rollers and then a transverse force at a distal end of the pushbutton overcomes the force of the transverse compression spring causing the opening in the pushbutton to move and disengaging the sponge pin from the circumferential sidewall of the opening in the pushbutton, the crown is aligned with the movable piston and a force of the vertical compression spring causes the sponge pin to be ejected by the trigger mechanism also ejecting the brace and the sponge; and f. the trigger mechanism is retained within the housing which has a body with a vertical cutout through which the pushbutton is accessible.

7. The sponge roller mop in accordance with claim 6, further comprising: the elongated rod and the rod connector are formed in one piece.

8. The sponge roller mop in accordance with claim 6, further comprising: the elongated rod has male threads at its lower end and the rod connector has internal female threads to receive the male connector from the elongated rod.

9. The sponge roller mop in accordance with claim 6, further comprising: the elongated rod has a lower section with an opening and the rod connector has an opening extending therethrough to enable a pin to extend through a first opening in the elongated vertical housing through the opening in the lower portion of the elongated rod and through the second opening in the elongated vertical housing.

* * * * *